United States Patent [19]

Brindle

[11] 4,114,318

[45] Sep. 19, 1978

[54] PLUG DOOR OPERATING AND MOVING MECHANISM

[75] Inventor: Dale L. Brindle, Chambersburg, PA

[73] Assignee: Hennessy Products, Incorporated, Chambersburg, Pa.

[21] Appl. No.: 827,850

[22] Filed: Aug. 26, 1977

[51] Int. Cl.[2] ..... E05D 15/10; E05F 11/00

[52] U.S. Cl. ..... 49/215; 49/218; 49/360

[58] Field of Search ..... 49/360–363, 49/218, 220, 215

[56] References Cited

U.S. PATENT DOCUMENTS

| | | | |
|---|---|---|---|
| Re. 28,443 | 6/1975 | Ross, Jr. et al. | 49/220 |
| 3,990,184 | 11/1976 | Bollinger, Sr. | 49/360 X |

*Primary Examiner*—Philip C. Kannan
*Attorney, Agent, or Firm*—F. Travers Burgess

[57] ABSTRACT

Mechanism for moving plug type railway car doors transversely of the car side into and out of the door opening therein and longitudinally of the car side toward and away from the opening comprises a carriage adjacent the front of the door supporting the door directly on a mounting track and a mounting shaft adjacent the rear edge of the door supported via a crank on a track supported carriage, a longitudinal rack on the car side adjacent the door with manually actuated pinion means supported thereon and movable longitudinally thereof, operating means on the door actuable by longitudinal movement of the pinion means for unlatching the door and for rotating the door mounting shaft to move the door outwardly and inwardly, including means for automatically disconnecting the operating means from rotation-producing relation with the mounting shaft when the door is latched and when the door is being moved longitudinally of the car, and stiff resilient means for retaining the door in its selected outward and inward positions and thereby eliminating the possibility of interference betewen the door and car side during longitudinal movement of the door, into and out of registry with the door opening therein.

18 Claims, 15 Drawing Figures

PLUG DOOR OPERATING AND MOVING MECHANISM

BACKGROUND OF THE INVENTION

1. Field of the Invention

The invention relates to door structures, and particularly to mechanism for sequentially unlatching and latching plug doors, such door moving transversely inwardly and outwardly of the door opening in a wall and moving the doors longitudinally of the wall out of and into registry with the door opening.

2. The Prior Art

U.S. Pat. No. 3,990,184 to Luther L. Bollinger, Sr. discloses doors of the type in which the front end of the door track curves from an outwardly spaced portion parallel to the car side toward the car side near the front edge of the door opening, with the front portion of the door directly mounted on a track mounted carriage and the rear portion of the door mounted by means of a crank on a track mounted carriage for movement into and out of the door opening by rotation of the crank mounting shaft, longitudinally slidable means on the door for unlocking the door and rotating the door-mounting shaft between the flush and outboard portions, with the longitudinally slidable mechanism on the door connected to a manually actuated pinion driving gear box carried by a rack on the car side, whereby through movement of the gear box along the rack in selected directions the longitudinally movable means on the door is caused to rotate the door mounting shaft out of or into door closed position and the door is moved longitudinally of the car into and out of registry with the door opening in the side wall thereof. In this patent, operation of the door mounting shaft requires that under certain conditions, a pair of longitudinally movable bars on the door be moved in unison and that under other conditions individual bars be moved separately and provides a mechanism including a lever mounted on the shaft and operable thereby and a co-operating cam on the locking pin to disengage and engage the two longitudinally movable bars responsive to relative positions of the mounting shaft. The patented construction also relies solely on the maintenance of the operating mechanism in its selected position to maintain the mounting shaft in its selected door closed or door open position.

SUMMARY OF THE INVENTION

The invention provides improved means responsive to selected movements lengthwise of a railway car plug door for unlocking the door and automatically moving the door out of the door opening in the car side before initiation of longitudinal movement of the door along the car side and away from the opening.

The invention provides in a door arrangement of the general type referred to above, improved means for disengaging and re-engaging locking means holding a pair of longitudinally movable operating bars to each other responsive to relative movements between one of the bars and the operating link connecting that bar to the mounting shaft.

The invention also provides in a door of the type referred to above, means for retaining the shaft in the selected door open and door closed positions, whereby to prevent undesired transversely inward movements of the door during longitudinal movement of the door along the car side wall.

The invention provides a stiffly resilient over-center toggle connection between the door and the mounting shaft for maintaining the door in desired inner or outer positions.

The invention provides the above features in combination with a door of the type in which the door mounting track curves inwardly toward the car side adjacent the forward end of the door opening therein and extends parallel to the car side rearwardly of the door opening, the front end portion of the door being supported directly on a carriage riding on the track for movement therealong into and out of the door opening and the rear edge of the door being supported from a track mounted carriage by a crank at the lower end of a shaft journaled on the door, the crank being pivotally supported on the last-named carriage.

DETAILED DESCRIPTION OF THE DRAWINGS

DETAILED DESCRIPTION OF THE INVENTION

Figure 1:
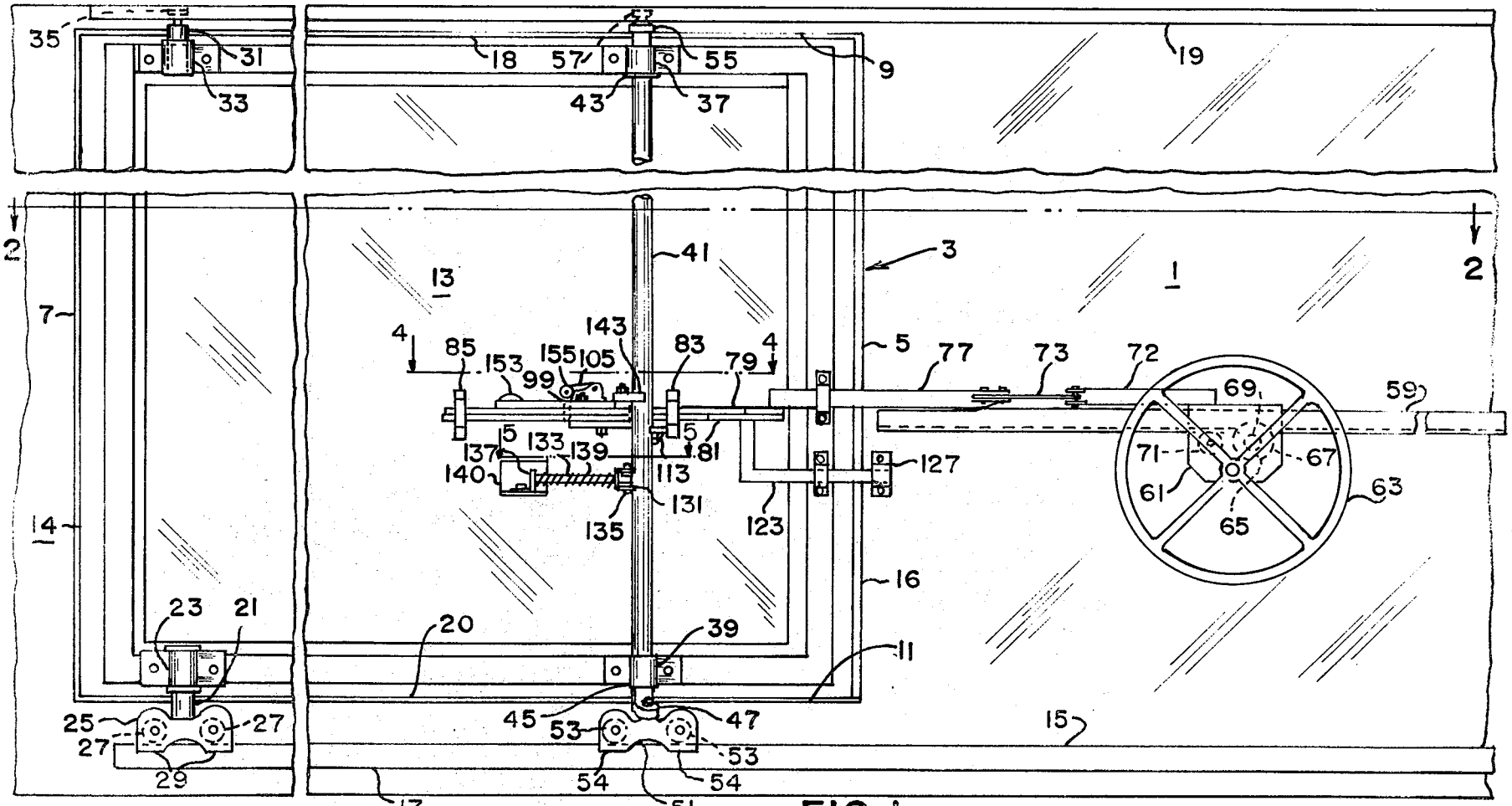
FIG. 1 is a partial side elevational view of a railway house car showing door operating mechanism embodying the invention in the fully closed and locked condition.
Figure 2:
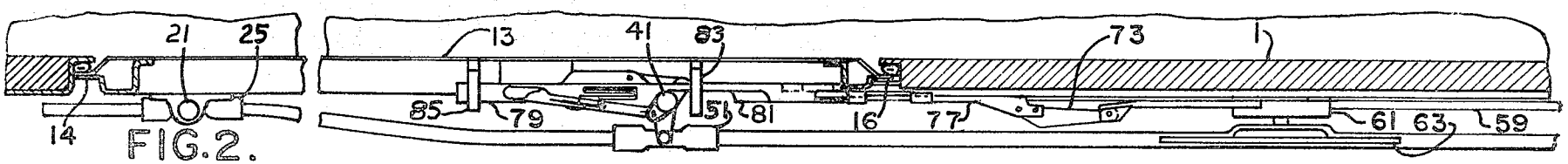
FIG. 2 is a horizontal sectional view taken along line 2—2 of FIG. 1.

Referring to FIGS. 1 and 2, a railway house car side wall 1 is formed with a rectangular door opening 3 defined by rear and front vertical edges 5 and 7 respectively and at the top by side plate 9 and at the bottom by threshold 11.

A rectangular door 13 is received in the door opening when closed, with its outer surface substantially flush with the outer surface of car side wall 1 and with its front edge 14, its rear edge 16 and its top and bottom edges 18 and 20 in close proximity with the rear and front vertical edges 5 and 7, side plate 9 and threshold 11 respectively.

A horizontal track 15 is mounted on car side wall 1 below the door opening with its front end portion 17 diverging outwardly from the car side wall and the remainder of the track rearwardly thereof being uniformly spaced outwardly from the car side wall in parallel relation therewith throughout its length. Above the door opening, a downwardly open channel-shaped retainer rail 19 is mounted on the car side plate 9 and is similarly divergent and spaced in parallel relation from the car side.

For supporting door 13 on the car side so that during opening movements it moves transversely out of opening 3 and longitudinally rearwardly therefrom, a short vertical stub shaft 21 is rotatably mounted in a bearing 23 on the front portion of the car door near its lower edge and is fixed to a roller carriage 25 which rotatably mounts a pair of rollers 27 resting on track 15 and having sides 29 depending below rollers 27 to guidably engage the sides of track 15.

Adjacent the top of door 13 a similarly upwardly extending stub shaft 31, rotatably mounted in a bearing 33 on door 13 in vertical alignment with shaft 21, mounts at its upper end a roller 35 engaging the inner surface of door retainer rail 19.

Near the rear edge of the door in longitudinally spaced relation therewith, a pair of bearings 37 and 39 are mounted on the door near its top and bottom edges respectively and a vertical mounting shaft 41 is rotatably journaled in bearings 37 and 39 and projects therefrom below and above the door, thrust collars 43 and 45 on shaft 51 underlyingly engaging bearings 37 and 39 respectively to prevent downward movement of the door with respect to shaft 41.

At its lower end shaft 41 mounts bottom operating crank 47, which extends transversely outward from shaft 41 at a substantial angle to the car side when the door is fully closed. At its outer end, crank 47 is pivotally supported at 49 on a roller carriage 51, rotatably mounting rollers 53 resting on track 15. The sides 54 of carriage 51 depend below the top of track 15 and guidably engage the sides thereof to prevent movement of carriage 51 transversely of track 15.

At its upper end shaft 41 mounts inwardly extending top operating crank 55 which extends transversely outwardly from shaft 41 at a substantial angle to the car side when the door is fully closed and on the outer end of which is journaled a vertical-axis roller 57, which is received between the vertical flanges of door retainer rail 19.

It will be evident that the door can be opened by rotating shaft 41 counterclockwise slightly less than a quadrant, thereby moving operating cranks 47 and 55 from their closed-door positions substantially angular to the car side wall to open-door positions wherein they extend rearwardly from shaft 41 substantially parallel to the car side wall, whereby they cause the rear end of the door to move transversely out of the opening, after which the entire door can be moved rearwardly longitudinally of the car out of registry with the opening. As front carriage 25 and front retainer roller 31 follow the front ends of track 15 and retainer rail 19 as they diverge outwardly from the wall, the front edge of the door moves outwardly until the door and car side are in parallel spaced relation with each other and thence along the car side wall to a position clear of the door opening 3.

For effecting opening and closing movements of the door, a downwardly toothed horizontal rack 59 is secured to side wall 1 rearwardly of door opening 3 and a gear box 61 is slidably mounted on top of rack 59 for movement lengthwise thereof. Gear box 61 rotatably mounts a handwheel 63 and contains reduction gearing 65, 67 drivingly connecting handwheel 63 to rack-engaging driving pinion 69. An idler pinion 71 spaced longitudinally of the gear box from driving pinion 69 engages the bottom of the rack and co-operates with driving pinion 69 to stabilize the gear box against tilting lengthwise of rack 59.

For connecting the gear box to the door, gear box 61 is formed with a forwardly extending connecting arm 72, to the front clevis-like end of which the rear end of a link 73 is pivoted, the front end of link 73 being pinned to the rear clevis-like end of extension bar 77, the front end of the latter being rigidly secured to the rear end of an upper operating bar 79 which, along with a lower operating bar 81, is slidably mounted in a pair of longitudinally spaced brackets 83 and 85 on the door, operating bars 79 and 81 being positioned horizontally with their respective bottom and top surfaces in opposed slidable engagement with each other and being formed respectively with elongated outwardly open recesses 87 and 89 to permit the portions of the bars inwardly of the recess to pass between operating shaft 41 and the outer surface of door 13.

Figure 3:
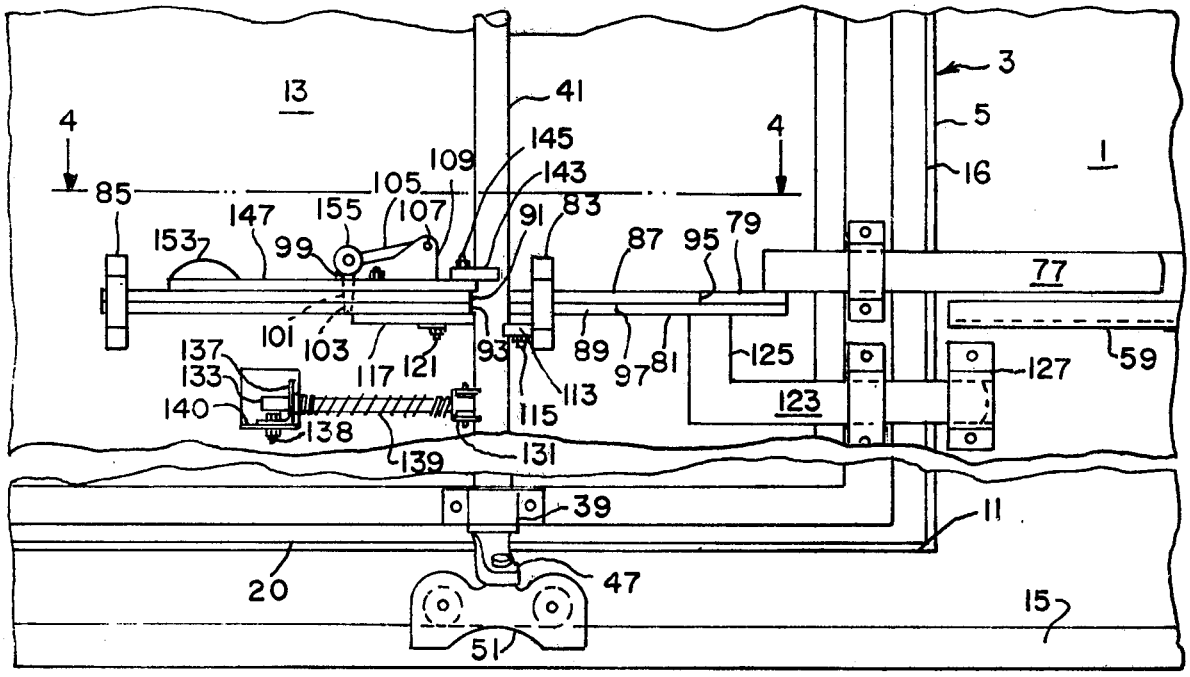
FIG. 3 is an elevational view of the door operating mechanism in the fully closed and locked condition shown in FIGS. 1 and 2.
Figure 4:
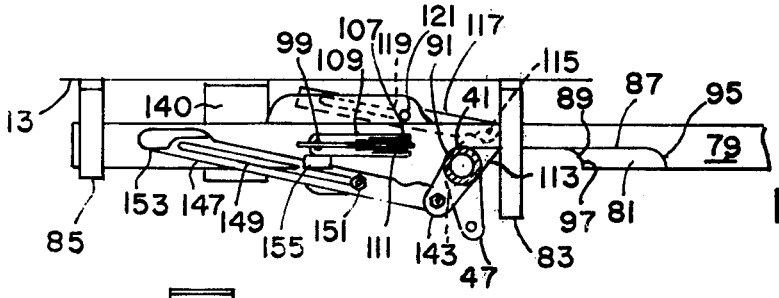
FIG. 4 is a horizontal sectional view taken along the line 4—4 of FIGS. 1 and 3.
Figure 5:
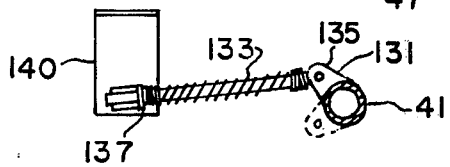
FIG. 5 is a fragmentary horizontal sectional view taken along line 5—5 of FIGS. 1 and 3.

With the door in the fully closed position illustrated in FIGS. 1 and 2 and the operating mechanism parts in the position best seen in FIGS. 3–5, the front arcuate ends 91 and 93 of recesses 87 and 89 of upper and lower operating bars 79 and 81 are aligned with each other in abutting relation with the front surface of shaft 41, and the rear arcuate end 95 of upper operating bar recess 87 is positioned a substantial distance rearwardly of the rear arcuate end 97 of lower operating bar recess 89. At the same time, the operating bars 79 and 81 are held against relative longitudinal movement by a vertically movable locking pin 99 which extends through a hole 101 in the upper operating bar and into a registering hole 103 in lower operating bar 81. For maintaining the locking pin 99 in its downward locking position and lifting it therefrom under certain conditions to be described hereinbelow, pin 99 is pivotally connected at its upper end to the forward end of longitudinally extending pin lifter lever 105, the rear end of which is pivoted on a transverse axis at 107 to upstanding bracket structure 109 mounted on upper operating bar 79 forwardly of the front end 91 of recess 87 therein, and a spring 111 biases lifter lever 105 counterclockwise about its pivot axis 107 to hold locking pin 99 downwardly in its locking position in holes 101 and 103 in upper and lower operating bars 79 and 81.

For rotating operating shaft 41 from the door closed and locked position of FIGS. 1–4 in which cranks 47 and 55 extend outwardly from the shaft at a substantial angle to the side of the car, counterclockwise to a position in which cranks 47 and 55 extend rearwardly from the shaft generally parallel to the car side wall so as to position the rear edge of the door outwardly of the car side wall, shaft 41 is provided at a level lower than the lower operating bar with an inwardly and rearwardly extending arm 113 to which is pivotally secured at 115 a generally rearwardly extending lower actuating link 117 formed with an axial closed end lost-motion slot 119 in the forward end of which is slidably received lower actuating pin 121.

Near its rear end an L-shaped latch bar 123 is secured by its upright leg 125 to lower operating bar 81 and when the door is fully closed and locked, locking bar 123 extends into a co-operating keeper 127 on the car side immediately rearwardly of the door opening.

In order to initiate opening movement of the door, handwheel 63 is manually rotated such that gear box 61 and with it link 73, extension arm 77 and the upper and lower operating bars 79 and 81, locked together by locking pin 99, all move forwardly in unison with respect to the door which is held against the forward movement by the engagement of its front edge with the front edge 7 of the door opening. As the upper and lower operating bars are thus moved forwardly, latch bar 123 moves forwardly with the lower operating bar 81 until latch bar 123 is fully retracted from keeper 127 to the position shown in FIG. 6, thus making it possible to begin to move the rear edge of the door outwardly transversely of the car side from the door opening.

Figure 6:
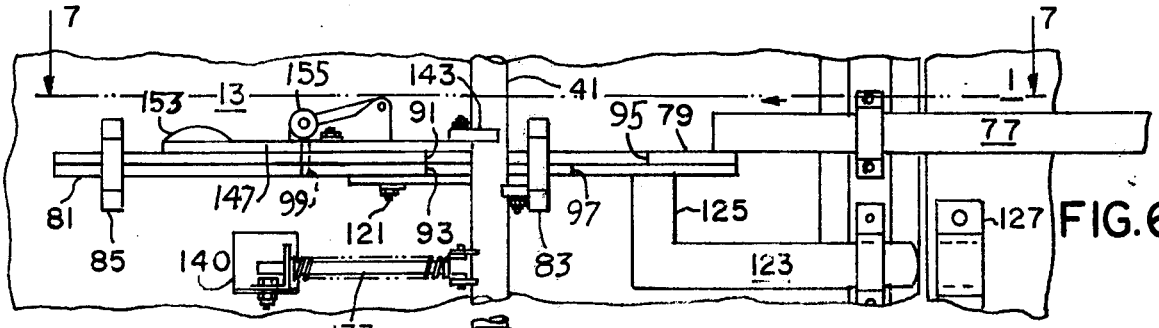
FIG. 6 is an elevational view of the door operating mechanism showing the initial step in the opening sequence, with the door unlocked but still in the fully closed position.
Figure 7:
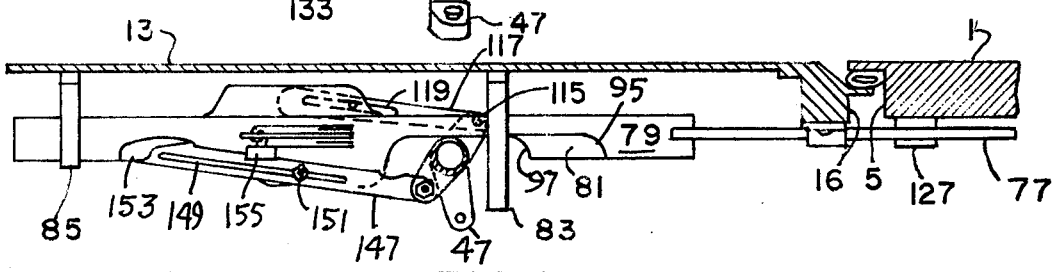
FIG. 7 is a horizontal sectional view taken along line 7—7 of FIG. 6.
Figure 8:
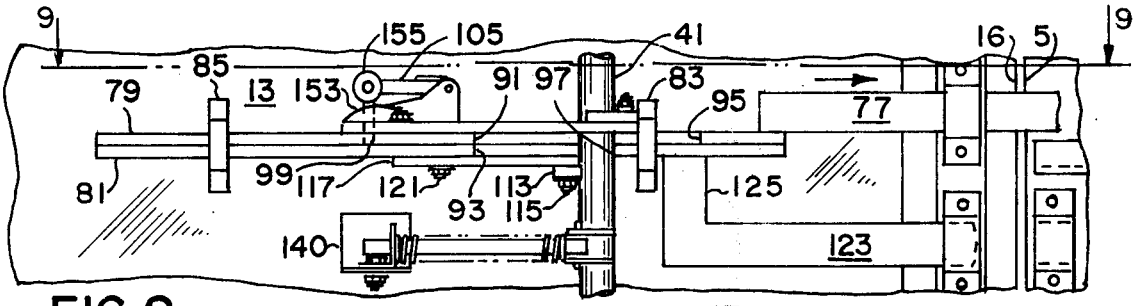
FIG. 8 is a side elevational view of the door operating mechanism showing the second step in the opening sequence, in which the operating shaft has been rotated to move the rear edge of the door outwardly of the opening in the car side completely clear transversely of the car side.
Figure 9:
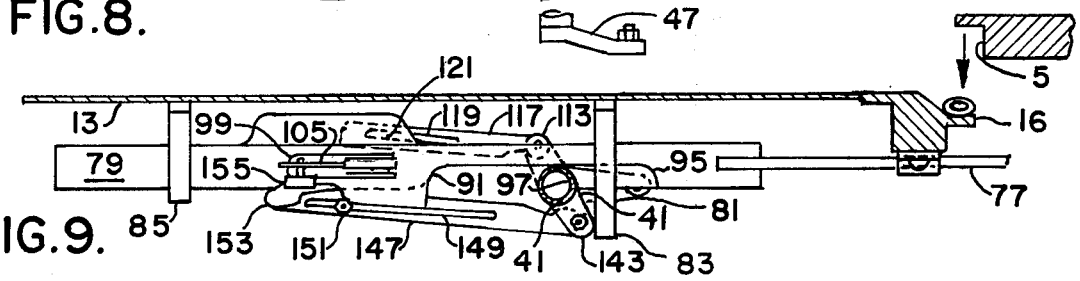
FIG. 9 is a horizontal sectional view taken along line 9—9 of FIG. 8.

Continued forward movement of gear box 61 causes continued forward movement of the upper and lower operating bars to the position shown in FIGS. 6 and 7 during which lower actuating pin 121 on the lower operating bar engages the forward end of lost-motion slot 119 in lower actuating link 117, such that continued forward movement of the lower operating bar thereafter causes lower actuating link 117 to move rearwardly toward the position shown in FIGS. 8 and 9, wherein the mounting shaft 41 has been rotated counterclockwise nearly 90° thus causing cranks 47 and 55 to rotate similarly counterclockwise and thereby move the mounting shaft 41 and with it the rear portion of the door outwardly with respect to the door-mounting carriage 51 and the car side.

For securing the door in the outward position, a resilient over-center toggle device shown in elevation in FIGS. 1, 3, 6, 8, 10, 12 and 14 and in plan in FIG. 5 comprises a positioner toggle arm 131 which extends generally forwardly and inwardly from the operating shaft, when the latter is in the closed door position, wherein lower actuating arm 113 on shaft 41 engages bracket 83 as a stop. A guide rod 133 is pivoted at its rear end at 135 to arm 131 and the front end of guide rod 133 extends slidably through a hole in the vertical web of an angle bracket 137 pivotally mounted at 138 via its horizontal web on a shelf 140, the door forwardly of shaft 41, and a stiff helical spring 139 surrounds guide rod 133 and is compressed between the arcuate terminal of arm 131 and angle bracket 137, such that as shaft 41 is rotated counterclockwise by rearward movement of lower actuating link 117, arm 131 is similarly rotated counterclockwise and with it spring guide rod 133 is rotated over-center to the position shown in broken lines in FIG. 3, wherein the high pressure exerted by spring 139 on arm 131 maintains arm 131 and shaft 41 in the door-outward position, as shown in FIGS. 8 and 9. Spring 139 is preferably under approximately 100 pounds pressure whereby to prevent any accidental rotation of the shaft from its selected position, thus requiring manipulation of handwheel 63 and consequent longitudinal movement of gear box 61 to cause any rotation of shaft 41.

For rotating mounting shaft 41 clockwise to return the door to its fully closed position, the mounting shaft 41 is formed with a radial upper actuating arm 143 extending in a diametrally opposite direction from lower actuating arm 113, i.e., generally outwardly and forwardly from shaft 41, when the door is fully closed as seen in FIGS. 1 and 2, and generally outwardly and rearwardly from shaft 41 when the door is in its outward position as shown in FIGS. 8 and 9, with the outer end of arm 143 engaging bracket 83 as a stop. At 145 a forwardly extending upper actuating link 147 is pivotally secured to upper actuating arm 143. Upper actuating link 147 is formed with an axially elongated lost-motion slot 149 in which is positioned an upper actuating pin 151 mounted on upper operating bar 79, upper actuating pin 151 being received in the forward end of lost-motion slot 149 when the door is in its fully closed position, as shown in FIGS. 1–4. At its forward end, upper actuating link 147 is formed with an upwardly extending longitudinally elongated arcuate cam surface 153 adapted to underlyingly engage a follower roller 155 mounted on the forward end portion of pin lifter lever 105, such that when the upper and lower operating bars reach the position shown in FIGS. 8 and 9, wherein the rear end portion of the door has been fully moved outwardly from the opening, follower 155 rides on top of cam 153 thereby lifting locking pin 99 out of the hole 103 in the lower operating bar so that the upper operating bar can be moved rearwardly without causing corresponding movement of the lower operating bar.

Figure 10:
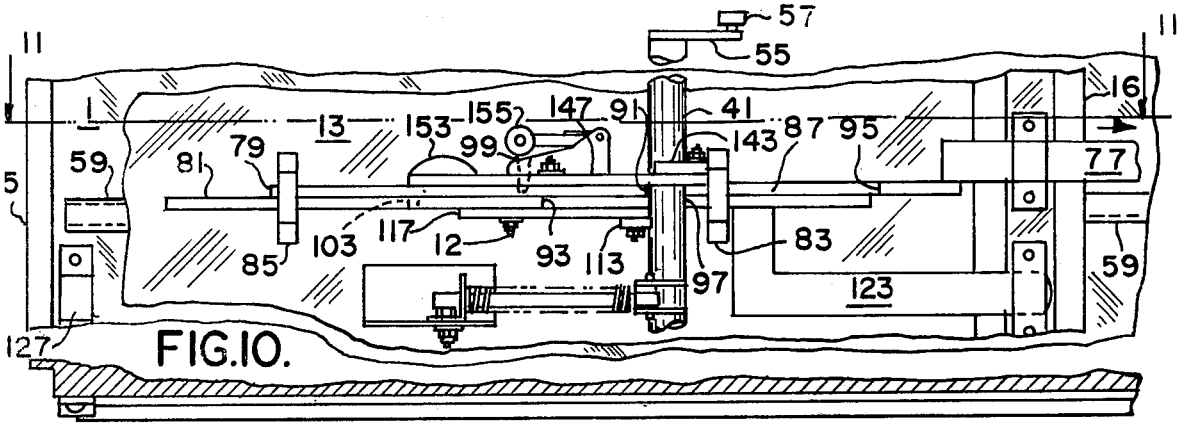
FIG. 10 is a side elevational view of the mechanism, illustrating the third step in the opening sequence, in which the door is being moved longitudinally of the car out of registry with the door opening in the car side wall.
Figure 11:
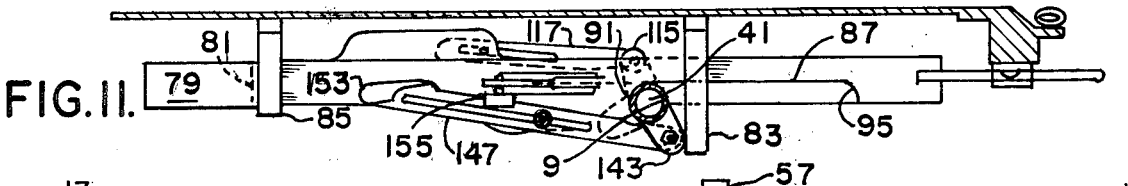
FIG. 11 is a horizontal sectional view taken along the line 11—11 of FIG. 10.

When this occurs rearward movement of the door longitudinally of the car side out of registry with the opening therein can be initiated as best seen in FIGS. 10 and 11 by rotating handwheel 63 such that gear box 61 moves rearwardly on rack 59, pulling with it upper operating bar 79 until the forward edge 91 of its recess 87 engages the front surface of shaft 41, thereby pulling the shaft and with it the entire door rearwardly parallel to the car side. Because of the outward divergence of the forward end of the mounting track 15 and retainer rail 19 from the car side, front mounting carriage 25 and front retainer roller 35 will cause the front edge of the door to move outwardly until the door is entirely parallel to the car side wall, after which continued rearward movement of gear box 61 will pull the entire door rearwardly parallel to the side wall until the front edge of the door is substantially aligned with the rear edge of the door opening and the door is fully opened.

During opening movement of the door, any tendency of the mounting shaft to permit the door to move inwardly transversely toward the side wall is strongly opposed by the action described above of the resilient toggle positioning device 131–139.

Operation of the device is as follows: With the door in the position shown in FIGS. 1–4, with the door mounting cranks 47 and 55 extending outwardly from the mounting shaft at a substantial angle to the car side, and the door in locked position with the latch bar extended rearwardly of the door into keeper 127 on the car side at the rear edge of the door opening, in order to open the door, the gear box handwheel 63 is rotated such that the gear box 61 moves forwardly on rack 59 causing the extension arm 77 and with it the upper and lower operating bars 79 and 81 and latch bar 125 to move correspondingly forwardly to the position shown in FIGS. 6 and 7, in which the latch bar 125 is fully retracted from its keeper 27 on the car side wall.

Further forward movement of the upper operating bar 79 continues to produce a corresponding forward movement of the lower operating bar 81 and corresponding forward movement of lower actuating pin 115 through lost motion slot 119 in lower actuating link 117 until lower actuating pin 115 reaches the forward end of slot 119 in lower actuating link 117, by which it causes the lower actuating link to move forwardly with the operating bars and thereby initiate counterclockwise rotation of mounting shaft 41, as viewed in FIGS. 6 and 7, to the position shown in FIGS. 8 and 9. During this movement of mounting shaft 41, door mounting cranks 47 and 55 move correspondingly counterclockwise from their door-closed position substantially angular to the car side to a position substantially parallel to the car side, thereby shifting the rear edge of the door transversely outwardly of the door opening. Simultaneously, the corresponding rotation of toggle arm 131 on mounting shaft 41 compresses the positioner spring 131 along guide member 133 and when mounting shaft 41 reaches the full-outward position of the door, the toggle pivot 135 is moved over-center to the door open position shown in FIGS. 5 (broken lines) and 8, wherein pressure exerted by spring 131 maintains mounting shaft 41 in the door-open position.

Meanwhile, as operating bars 79 and 81 move forwardly and as mounting shaft 41 is rotated counterclockwise, upper actuating link 147 is moved rearwardly relative to the operating bars by the counterclockwise movement of arm 143 until pin lifting cam 153 on the forward end of upper actuating link 147 underrides follower 155 on the locking pin lifter lever 105, thereby lifting locking pin 99 out of its hole 103 in lower operating bar 81, such that rearward movement of gear box 61, extension arm 77 and upper operating bar 79 does not cause any corresponding rearward movement of lower operating bar 81 and projection of latch bar 123 or disturb the door-outward position of mounting shaft 41 and door-mounting cranks 47 and 55.

The door may then be shifted rearwardly by moving gear box 61 rearwardly along rack 59, such that the forward edge of recess 87 in upper operating bar 79 engages mounting shaft 41 and pulls the door rearwardly to the full open position as shown in FIGS. 10 and 11, toggle device 131–139 all the while acting on mounting shaft 41 to maintain the mounting shaft continuously in the door-outward position, well clear of all structure on the car side wall. The front portion of the door moves outwardly of the opening as its carriage 25 follows the rearward divergence of track 15 from the car wall.

Figure 12:
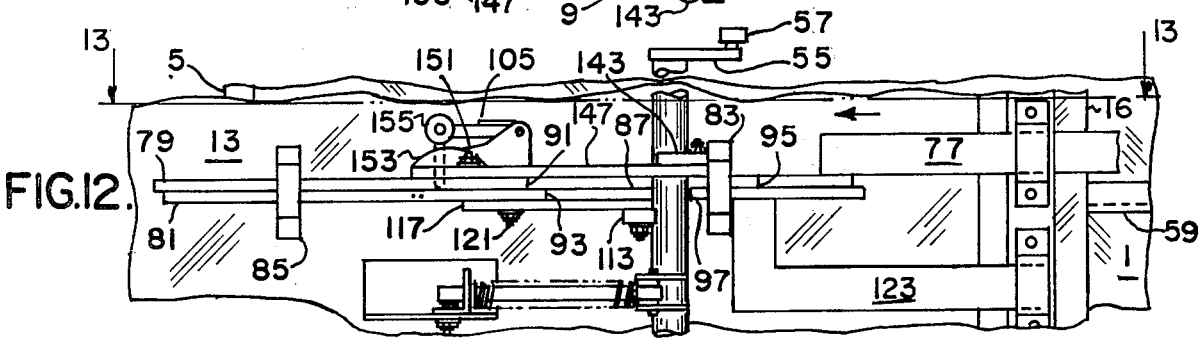
FIG. 12 is a side elevational view of the mechanism, illustrating the first step in the closing sequence as the door is moved forwardly longitudinally of the car side wall toward its closed position in registry with the door opening.
Figure 13:
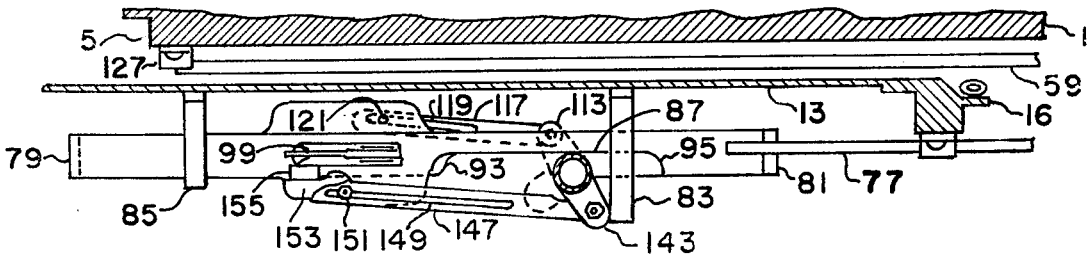
FIG. 13 is a horizontal sectional view taken along the line 13—13 of FIG. 12.
Figure 14:
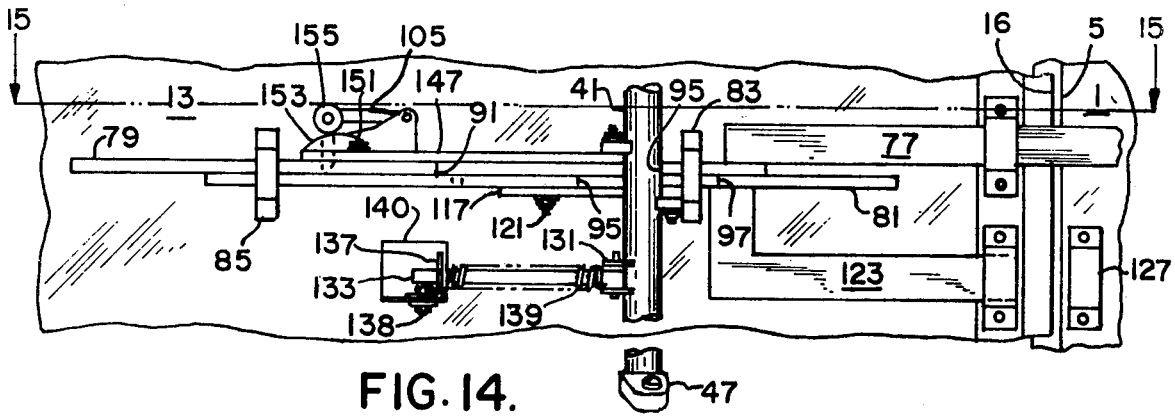
FIG. 14 is a side elevational view of the operating mechanism showing the final step in the closing sequence prior to locking of the door, in which the door has been moved from the transverse outward position to the fully closed position in the door opening flush with the car side wall.
Figure 15:
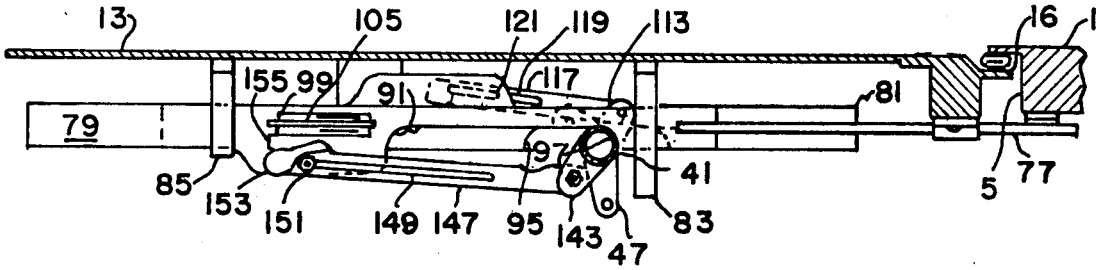
FIG. 15 is a horizontal sectional view taken along line 15—15 of FIG. 14.

For closing the door after it has been full opened, gear box 61 is moved forwardly on the rack causing extension arm 77 to move the upper operating bar forwardly until rear edge 95 of recess 87 therein engages mounting shaft 41, as seen in FIGS. 12 and 13, so as to push mounting shaft 41 and with it the entire door longitudinally of the car wall until the door is in registry with the opening therein, the forward carriage 25 on the door having moved the forward edge of the door inwardly into the opening by reason of the inward direction of the forward end of the door track.

As the forward edge of the door approaches the forward edge of the door opening, where further forward movement of the door is prevented, upper actuating pin 151 on the upper operating bar has moved forwardly in slot 149 in upper actuating link 147 until it reached the forward end of slot 149 so as to pull forwardly on upper actuating arm 143 on mounting shaft 41 and rotate the latter clockwise to the door-closed position, wherein the door-mounting cranks 47 and 55 extend outwardly from mounting shaft 41 to force the door inwardly transversely of the side wall to its fully closed position. Thus movement of the mounting shaft moves the toggle arm 131 clockwise, compressing toggle spring 139 to a dead center position when the positioner spring guide and the positioner spring are aligned, after which the expansion of the spring 139 to the solid line position of FIG. 5 aids the clockwise rotation of mounting shaft 41 to its door-closed position and holds it there.

When this occurs, handwheel 63 is reversed and gear box 61 is moved rearwardly on rack 59, such that extension arm 77 pulls the upper operating bar 79 rearwardly, moving the pin lifter follower 155 rearwardly out of engagement with the pin-lifting cam 153 on upper actuating link 147, so that when locking pin hole 101 in upper operating bar 79 becomes vertically aligned with locking pin hole 103 in lower operating bar 81, pin lifter spring 11 forces locking pin 99 downwardly into hole 103 in lower operating bar 81 and further rearward movement of gear box 61, extension arm 77 and upper operating bar 79 causes corresponding rearward movement of the lower operating bar 81 and of the latch bar 125 into keeper 127 on the side wall rearwardly of the door. Because of lost motion slot 119 in lower actuating link 117, the lower actuating pin 121 simply moves rearwardly in the slot during this last-named movement of lower operating bar 81 and has no effect on the rotational position of mounting shaft 41. Similarly, the rearward movement of the upper operating bar 79 is accompanied by rearward movement of its actuating pin 151 in lost motion slot 149 of upper actuating link 147 and has no effect on the rotational position of mounting shaft 41. The door and the door operating mechanism will be in the positions shown in FIGS. 1–5 in which the door is latched in its flush position in the car side with all the parts in readiness for another opening movement.

The details of the mechanism may be varied substantially without departing from the spirit of the invention and the exclusive use of such modifications as come within the scope of the appended claims is contemplated.

I claim:

1. In combination, a wall having a door opening, a plug door for said opening, means mounting said door for movement transversely of the wall between positions within and outside of said opening and longitudinally of the wall out of and into longitudinal registry with said opening, said mounting means including a track mounted on the wall generally in parallel relation therewith, a carriage riding on said track structure fixed against movement longitudinally of said door including an upright shaft rotatably journaled on the door and having a crank pivotally mounted on said carriage and rotatable by said shaft between a door closed position angular and a door open position generally parallel with respect to said wall, means for selectively rotating said shaft between door open and door closed positions, and resilient rotation-resisting means mounted on said door and engaging said shaft for maintaining said shaft in the selected door-closed and door-open rotational positions.

2. The combination according to claim 1, including operating means mounted on said door for movement longitudinally thereof and connected to said shaft for rotating said shaft between door outward and door inward positions transversely of the wall and engageable with said fixed structure for moving said door longitudinally of the wall into and out of registry with the door opening therein responsive to longitudinal movements of said operating means.

3. The combination according to claim 2, including a longitudinally extending rack on said wall rearwardly of said door opening therein, a selectively operable pinion device mounted on said rack for movement lengthwise thereof and engageable with said rack to effect such movement, and means connecting said pinion device to said door-mounted operating means for movement longitudinally of the wall responsive thereto.

4. The combination according to claim 3, including co-operating stop means on said shaft and said door limiting rotational movements of said shaft to the door-open and door-closed rotational positions.

5. The combination according to claim 4, wherein said rotation-resisting means comprises an over-center toggle device having an arm mounted radially on said shaft, a second arm pivoted to said shaft-mounted arm, a mounting bracket on said door slidably receiving said second arm, and a compression spring on said second arm between said mounting bracket and said shaft-mounted arm, said shaft-mounted arm being positioned on said shaft such that both said arms are substantially aligned when said shaft is in an intermediate position between its door open and door closed positions.

6. The combination according to claim 4 wherein said operating means includes a first radial arm mounted on said shaft, a first longitudinally movable operating bar connected directly to said selectively operable means, a first link pivotally connected at one end to said first radial arm, and at its other end to said first bar for rotating said shaft toward door-closed position responsive to movement of said first bar forward longitudinally of the door.

7. The combination according to claim 6, including a second radial arm mounted on said shaft and extending therefrom in an opposite direction from said first arm, a second operating bar releasably connected to said first operating bar for movement therewith, and a second link having a pivotal connection at one end to said second arm and at its other end to said second bar for initiating rotation of said shaft towards the door-open position responsive to predetermined movement of said second bar forwardly longitudinally of the door.

8. The combination according to claim 7, wherein said stop means comprises a bracket on said door and opposed surfaces of said radial arms and of said bracket.

9. The combination according to claim 7, including means for moving both said bars forwardly in unison, one of the pivotal connections of each of said links being a lost-motion connection accommodating lost-motion of different relative lengths, of the respective bars with respect to the respective shaft-mounted radial arms, such that predetermined forward movements to different positions of the respective bars cause opposite rotational movements of said shaft, and means responsive to forward movement of said bars to a predetermined position to release the locking means holding said bars to movement in unison, whereby upon completion of door opening movement of the shaft caused by said second bar, said second link and said second radial arm, said second bar is freed from movement with said first bar, such that movement of said first bar past a predetermined position forward of said first-named position actuates the lost-motion connection thereof to said first radial arm and produces opposite rotation of said shaft toward said closed door position.

10. The combination according to claim 9, wherein said second bar mounts a rearwardly extending latch bar and the wall rearwardly of the door opening therein has a keeper slidably receiving said latch bar when the door is closed and said operating bars are in their rearmost positions, such that initial forward movement of said operating bars retracts said latch bar from said keeper before the lost-motion connection between said second operating bar and said second arm initiates rotation of said shaft toward door-open position.

11. The combination according to claim 10, wherein said locking means holding said first and second operating bars for longitudinal movement in unison comprises registering holes in said bars and a locking pin extending into both said holes, a cam on said first link, a follower connected to said locking pin and engageable with said cam when said bars have moved a sufficient distance forwardly to cause said second link to initiate opening movement of said shaft, whereby to extract said locking pin from the hole in said second bar and thereby permit continued movement of said first bar without accompanying forward movement of said second bar.

12. The combination according to claim 9, wherein said first operating bar is formed with longitudinally spaced shoulders engageable respectively with the forward and rear surfaces of said shaft, whereby upon selected rearward and forward movement of said first operating bar, one of said shoulders engages said shaft to pull said shaft and with it said door rearwardly of the wall when the operating means is moved rearwardly and the door is fully positioned outwardly of the wall, and said forwardly facing shoulders are engageable with the rear surface of said shaft to move said shaft and with it said door forwardly from open to closed position upon forward movement of said operating means while said door is positioned outwardly of the wall.

13. The combination according to claim 2, wherein said operating means comprises first and second parallel bars mounted on said door for movement lengthwise thereof, said first bar being selectively movable, means normally interconnecting said bars to cause them to move in unison, a latch member on said second bar projecting rearwardly from the door when the door is closed, a keeper on said wall rearwardly of the door slidably receiving said latch member, a first lost-motion connection between said first bar and said shaft for moving said shaft to rotate in a door-closing direction when said first bar is moved forwardly to a predetermined position on said door and for leaving said shaft rotationally motionless when said first bar is moved rearwardly with respect to said door, a second lost-motion connection between said second bar and said shaft for causing said shaft to rotate in a door-opening direction when said second bar is moved forwardly to a predetermined position on the door and for leaving said shaft rotationally motionless when said second bar is moved rearwardly, and means responsive to movement of said first bar forwardly beyond said second predetermined position for disengaging said interconnecting means and thereby permitting movement of said first bar rearwardly to engage said fixed structure and thereby move the door out of registry with the opening without causing corresponding rearward movement of said second bar and projection thereby of said latch member rearwardly of the door during such opening movement of said first bar.

14. In combination, a wall having a door opening, a plug door for said opening, means mounting said door for movement transversely of the wall between positions within and outside of said opening and longitudinally of the wall out of and into longitudinal registry with said opening, said mounting means including a track mounted on the wall in generally parallel relation therewith, a carriage riding on said track, an upright shaft rotatably journaled on the door and having a crank pivotally mounted on said carriage and rotatable by said shaft between a door closed position generally parallel and a door open position angular with respect to said wall, door moving means comprising first and second operating bars mounted in parallel on said door for movement lengthwise thereof, means for selectively moving said first bar, means normally interconnecting said bars to cause them to move in unison, a first lost-motion connection between said first bar and said shaft for causing said shaft to rotate in a door closing direction only when said first bar is moved forwardly with respect to said door past a predetermined position and for leaving said shaft rotationally motionless when said first bar is moved rearwardly with respect to said door, a second lost-motion connection between said second bar and said shaft for causing said shaft to rotate in a door opening direction when said second bar is moved forwardly with respect to the door to a second predetermined position rearwardly of said first predetermined position and for leaving said shaft rotationally motionless when said second bar is moved rearwardly, means responsive to forward movement of both said bars for disengaging said interconnecting means when said door is fully outwardly of the wall to permit rearward movement of said first bar into abutting engagement with the front surface of said operating shaft so as to cause rearward longitudinal opening movement of the door without corresponding rearward movement of said second bar and for permitting forward movement of said first bar into abutting engagement with the rear surface of said shaft so as to cause forward longitudinal closing movement of said door and thereafter to provide closing rotational movement of said shaft by means of the lost-motion connection between said first bar and said shaft without corresponding forward movement of the lost-motion connecting said second bar and said shaft and resultant opposing rotational movement of said shaft, said interconnecting means comprising aligned holes in both said operating bars and a locking pin extending into both said holes, said first lost-motion connection having a cam surface, said locking pin having a cam follower engageable with said cam surface when said door reaches the fully outward position with respect to the wall.

15. In combination according to claim 14, wherein said first lost-motion connection comprises a first radial arm on said shaft, a first link pivotally connected at its rear end to said radial arm and having a lost-motion connection at its forward end to said first bar, said cam comprising an elevated surface on said first link underlyingly engageable with said follower.

16. In combination according to claim 15, including a resilient element normally biasing said pin and follower toward said second bar, whereby to maintain said pin in said hole in said second bar when said first and second bar holes are in registry with each other except when said follower overrides said cam and to facilitate the return of said pin into said second bar hole when said holes are in registry with each other and said cam and follower are disengaged.

17. The combination according to claim 12, including a rearwardly extending latch bar on said second operating bar and a keeper on the wall rearwardly of the door opening therein slidably receiving said latch bar when the door is closed and said operating bars are in their rearmost door-closed position, such that initial forward movement in unison of said operating bars moves said latch bar correspondingly forwardly and out of said keeper before the lost-motion connection between said second operating bar and said shaft initiates rotation of said shaft toward door outward position.

18. The combination according to claim 12, wherein said selectively moving means comprises a selectively rotatable pinion, a rack fixed to said wall and extending rearwardly longitudinally of the wall from said door opening, said pinion being supported from said rack and engaged therewith whereby upon rotation of said pinion said operating means is moved longitudinally of said wall.

* * * * *

UNITED STATES PATENT AND TRADEMARK OFFICE

CERTIFICATE OF CORRECTION

PATENT NO. : 4,114,318

DATED : September 19, 1978

INVENTOR(S) : Dale L. Brindle

It is certified that error appears in the above-identified patent and that said Letters Patent are hereby corrected as shown below:

Column 8, line 62, "track structure" should read --track, structure--.

Column 11, lines 20-21, "generally parallel" should read --angular--; line 21, "angular" should read --generally parallel--.

Signed and Sealed this

Thirtieth Day of June 1981

[SEAL]

Attest:

RENE D. TEGTMEYER

Attesting Officer

Acting Commissioner of Patents and Trademarks